US006530363B1

(12) United States Patent
Blass et al.

(10) Patent No.: US 6,530,363 B1
(45) Date of Patent: Mar. 11, 2003

(54) VARIABLE DELIVERY PUMP AND COMMON RAIL FUEL SYSTEM USING THE SAME

(75) Inventors: James R. Blass, Bloomington, IL (US); Dennis H. Gibson, Chillicothe, IL (US); Mark F. Sommars, Sparland, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/549,780

(22) Filed: Apr. 14, 2000

Related U.S. Application Data

(60) Provisional application No. 60/129,700, filed on Apr. 16, 1999.

(51) Int. Cl.[7] ..... F02M 7/00

(52) U.S. Cl. ..... 123/446; 123/499

(58) Field of Search ..... 123/500, 501, 123/502, 503, 504; 251/30.01; 137/565.35; 417/307

(56) References Cited

U.S. PATENT DOCUMENTS 4,219,154 A * 8/1980 Luscomb ..... 239/91
4,699,351 A * 10/1987 Wells ..... 251/29
5,094,216 A * 3/1992 Miyaki et al. ..... 123/506
5,133,645 A * 7/1992 Crowley et al. ..... 417/279
5,957,674 A * 9/1999 Zenmei et al. ..... 417/505

* cited by examiner

*Primary Examiner*—Willis R. Wolfe
*Assistant Examiner*—Mahmoud Gimie
(74) *Attorney, Agent, or Firm*—Liell & McNeil

(57) ABSTRACT

Pressurized injector actuation fluid, such as oil or fuel, is supplied to high pressure common rail by a fixed displacement fluid pump. Variable delivery from the pump is achieved by selectively spilling pumped fluid through a digital-acting by-pass or spill valve. The by-pass valve is actuated by a momentary electrical signal, which causes internal fluid pressure in the valve to latch it in a closed condition. The digital-acting by-pass valve permits high precision variations in the pump delivery with rapid response times. Unit pump configurations, radial pump configurations, and axial pump configurations are disclosed for both fuel injection applications and non-fuel injection applications. A single pump with plural pistons can be used to power multiple independent hydraulic systems.

20 Claims, 8 Drawing Sheets

VARIABLE DELIVERY PUMP AND COMMON RAIL FUEL SYSTEM USING THE SAME

CROSS-REFERENCE TO RELATED APPLICATIONS

This application claims the benefit of prior provisional application No. 60/129,700, filed Apr. 16, 1999.

TECHNICAL FIELD

This invention relates to a variable delivery fluid pump and, more particularly to a common rail fuel system that utilizes the pump to supply actuation fluid to a common fluid accumulator or rail.

BACKGROUND ART

In a common rail fuel injection system, high pressure actuation fluid is used to power electronic unit injectors, and the actuation fluid is supplied to the injectors from a high pressure fluid accumulator, which is referred to as a rail. To permit variation of the fluid pressure supplied to unit injectors from the rail, it is desirable to vary the delivery of fluid to the rail from one or more actuation fluid pumps. Known common rail systems typically rely on either a single fluid pump that supplies fluid to the rail or a plurality of smaller displacement pumps that each supplies fluid to the rail. The volume and rate of fluid delivery to the rail has been varied in the past by providing a rail pressure control valve that spills a portion of the delivery from a fixed delivery pump to maintain the desired rail pressure.

Variable delivery pumps are well known in the art and are typically more efficient for common rail fuel systems than a fixed delivery actuation fluid pump, since only the volume of fluid need to attain the desired rail pressure must be pumped. For example, variable delivery has been achieved from an axial piston pump, e.g. a pump wherein one or more pistons are reciprocated by rotation of an angled swash plate, by varying the angle of the swash plate and thus varying the displacement of the pump. In such a pump, the swash plate is referred to as a "wobble plate". Variable delivery has also been achieved in fixed displacement, axial piston pumps by a technique known as sleeve metering, in which each piston is provided with a vent port that is selectively closed by a sleeve during part of the piston stroke to vary the effective pumping portion of the piston stroke.

While known variable delivery pump designs are suitable for many purposes, known designs are not always well suited for use with modern hydraulically actuated fuel systems, which require fluid delivery to the rail to be varied with high precision and with rapid response times measured in microseconds. In addition, known variable delivery pumps designs are typically complex, may be costly, and are subject to mechanical failure.

In one specific example, European patent application 307,947 of NIPPONDENSO CO.,LTD. shows a variable discharge fixed displacement high pressure pump that utilizes an electronically actuated pressure latching valve in order to control output from the pump. When this pump begins its pumping stroke, fluid from the pumping chamber can either be displaced back to the inlet or out of the outlet. At any time during the pumping stroke, an electronically actuated spill valve can be actuated to close the spill passage between the pump chamber and the inlet to the pump. When this occurs, pressure in the pumping chamber quickly rises, and the spill valve includes a closing hydraulic surface that holds it closed due to the high pressure in the pumping chamber. When the valve is closed, the fluid exits the pump through the outlet at high pressure. Once the valve is closed and sufficient pressure is present to hold the valve in its closed position, the solenoid can be deenergized and the valve will remain in its closed position. While the concept of using a pressure latching valve can be beneficial from the standpoint of conserving electrical energy, the NIPPONDENSO pump suffers from a number of drawbacks. First, because the flow area past the valve must be relatively large in order to accommodate the fluid displacement occurring during the pumping stroke, the spill valve must necessarily have a relatively large and heavy valve member, and a relatively long travel distance in order to have a sufficiently large flow area when the valve is in its open position. The result of this is to require a relatively large and strong solenoid, and acceptance of relatively long response times that are required to move the valve from its open position to its closed position. Because such a structure inherently causes conflicts between the control requirements and the flow requirements, the performance capabilities of the same must necessarily be compromised.

This invention is directed to overcoming one or more of the problems described above.

DISCLOSURE OF THE INVENTION

In one aspect of this invention, a variable delivery pump comprises a pump housing defining a pump chamber, a pump inlet and a pump outlet. At least one plunger is positioned to reciprocate in the pump housing. A by-pass valve including an electrically operated actuator and a valve block is attached to the pump housing and defines a valve inlet fluidly connected to the pump chamber. The by-pass valve further includes a primary closure member movably positioned in the valve block and a secondary closure member movably positioned in the valve block and operably coupled to the electrically operated actuator.

In another aspect of the invention, a fuel injection system comprises a common rail, a plurality of fuel injectors fluidly connected to the common rail, a source of fluid, and at least one variable delivery pump with a pump outlet fluidly connected to the common rail and a pump inlet fluidly connected to the source of fluid. The variable delivery pump comprises a pump in accordance with the preceding aspect of this invention.

In still another aspect of the invention, a method of controlling output from a variable delivery pump comprises the steps of (a) providing a variable delivery pump including at least one plunger positioned to reciprocate in a pump housing, a by-pass valve including an electrically operated actuator and a valve block attached to the pump housing and defining a valve inlet fluidly connected to a pump chamber, and further including a primary closure member movably positioned in the valve block, and a secondary closure member movably positioned in the valve block and operably coupled to the electrically operated actuator; (b) determining a desired effective pumping stroke for the variable delivery pump; and (c) closing the by-pass valve at a timing corresponding to the desired effective pumping stroke at least in part by moving the secondary closure member to a closed position and then applying a hydraulic force to move the primary closure member to a closed position.

BEST MODE FOR CARRYING OUT THE INVENTION

Figure 1:
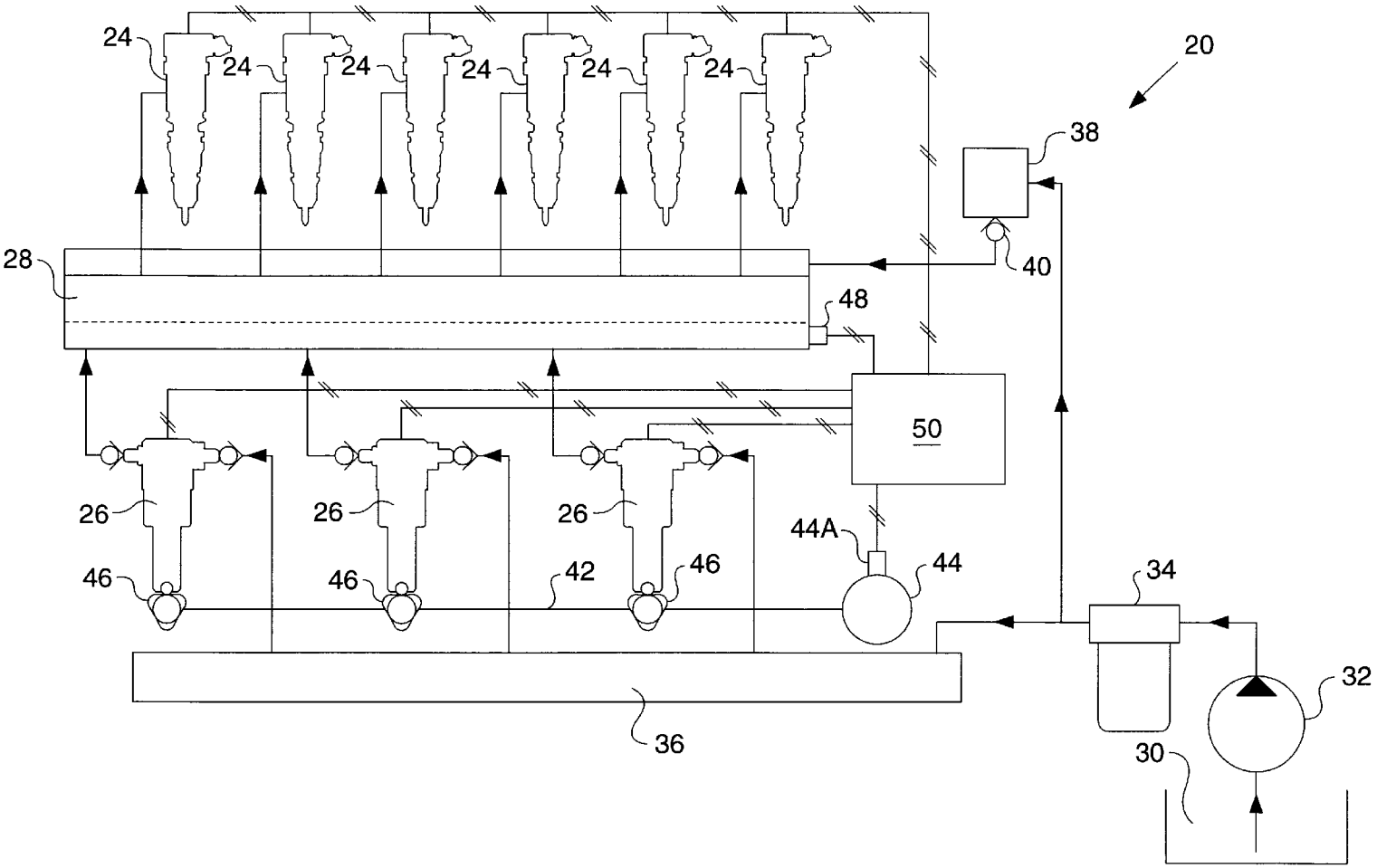
FIG. 1 is a diagrammatic representation of a common rail fuel injection system in accordance with this invention.

With reference to FIG. 1, a fuel injection system, generally designated 20 in accordance with this invention, for an internal combustion engine 22 (FIG. 2) comprises a plurality of unit injectors 24, which may be conventional but are preferably unit injectors having a nozzle check valve operable independent of injection pressure, such as the injectors described in commonly-owned U.S. Pat. Nos. 5,463,996, 5,669,335, 5,673,669, 5,687,693, 5,697,342, and 5,738,075. The preferred unit injectors are powered by pressurized engine oil, however those skilled in the art will recognize that this invention is equally applicable to common rail systems that use high pressure fuel to power the unit injector. Likewise, an intensified injector system is preferred, although this invention is also equally applicable to non-intensified injector systems.

The fuel system 20 further includes a plurality of variable delivery, reciprocating piston unit pumps 26, which supply high pressure fluid to a common high pressure fluid accumulator or rail 28. In the case where the injector actuation fluid is pressurized engine oil, oil is drawn from a sump or tank 30 in the engine 22 via an engine lube pump 32 and pumped through an oil filter 34 to the main engine oil gallery 36. Each unit pump 26 draws oil from the engine oil gallery 36 and pumps high pressure oil to the common high pressure rail 28. Although the illustrated system shows unit pumps 26 drawing fluid from gallery 36, they could instead draw fluid directly from sump 30 or any other suitable source of fluid. In addition, oil from the sump 30 is also delivered to an elevated reservoir 38, which delivers fluid to the high pressure rail 28 via a check valve 40 for thermal make-up under low temperature conditions. An associated camshaft 42 internal to the engine 22 drives each of the unit pumps 26, and the camshaft 42 is driven by the crankshaft 44 of the engine 22. The illustrated camshaft 42 have three lobes 46 at the location of each unit pump 26, but it will be recognized that the camshaft 42 may be provided with more or less than three lobes 46 as appropriate for the particular application. In the illustrated embodiment, each unit pump 26 will undergo three pumping strokes per revolution of the camshaft 42.

Pressure in the high pressure rail 28 is monitored by a conventional pressure sensor 48, which provides an electronic pressure signal to a suitable, conventional electronic control module (ECM) 50. Based on the sensed rail pressure and the desired rail pressure, the ECM 50 determines whether to raise or lower the pressure in rail 28, as the case may be. As will be described below, the pressure in the rail 28 is varied by varying the rate of delivery of fluid to the rail 28 from one or more of the unit pumps 26. In general, the delivery from each unit pump 26 is varied by adjusting the effective pumping stroke of the unit pump 26, which is the duration during each compression stroke thereof that fluid is pumped through the outlet of the unit pump 26 instead of back to the engine oil gallery 36 or the sump 30 as will be discussed below. The effective pumping stroke of each unit pump 26 is related to the angular or rotary position of the camshaft 42 at the beginning of the effective pumping stroke and thus the angular position of the crankshaft 44 at the beginning of the effective pumping stroke. The rotary position of the crankshaft 44 is provided to the ECM 50 via a conventional timing sensor 44A, and based on the required change in rail pressure, if any, determined by the ECM 50, the ECM 50 adjusts the effective pumping stroke of one or more of the unit pumps 26.

Figure 2:
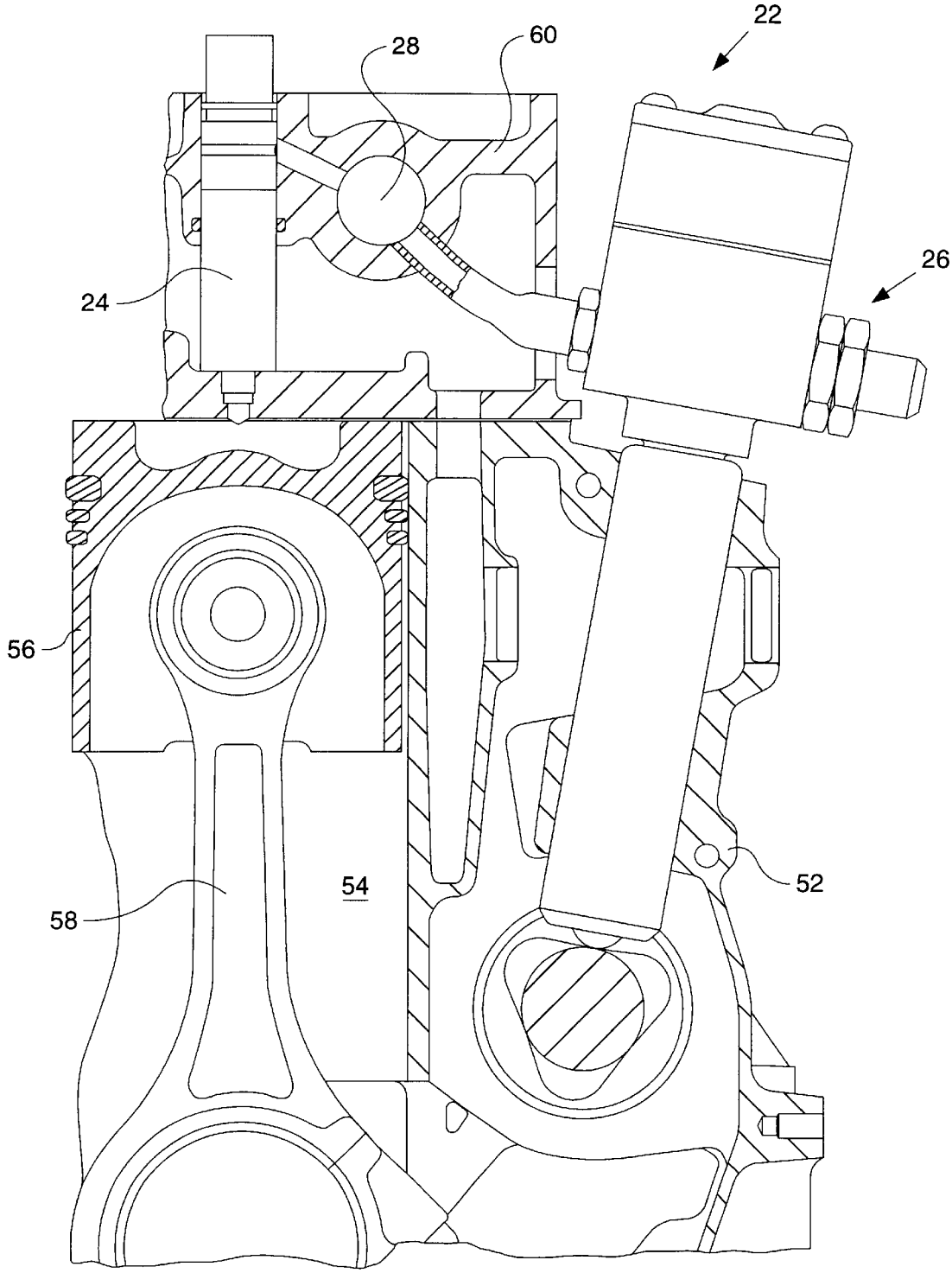
FIG. 2 is a fragmentary, cross-sectional view of a portion of an internal combustion engine utilizing one embodiment of variable delivery pump in accordance with this invention in connection with a common rail fuel system.

FIG. 2 illustrates a fragmentary portion of one cylinder of the internal combustion engine 22, which in this case is a diesel engine. One skilled in the art will recognize that various aspects of this invention may used with spark ignited engines if appropriate, as with gasoline direct injection for example. The engine 22, which may be conventional, includes a block 52 that defines one or more cylinders 54, only one of which is shown. A piston 56 reciprocates within the cylinder 54 and drives the crankshaft 44 via a connecting rod 58. The unit pump 26 is disposed within the block 54 and driven by the camshaft 42. FIG. 2 also illustrates one of the unit injectors 24 mounted in the head 60 of the engine 22, in which the high pressure fluid rail 28 is formed. Of course, one skilled in the art will recognize that the rail 28 may alternatively be a vessel separate from the head 60.

Figure 3:
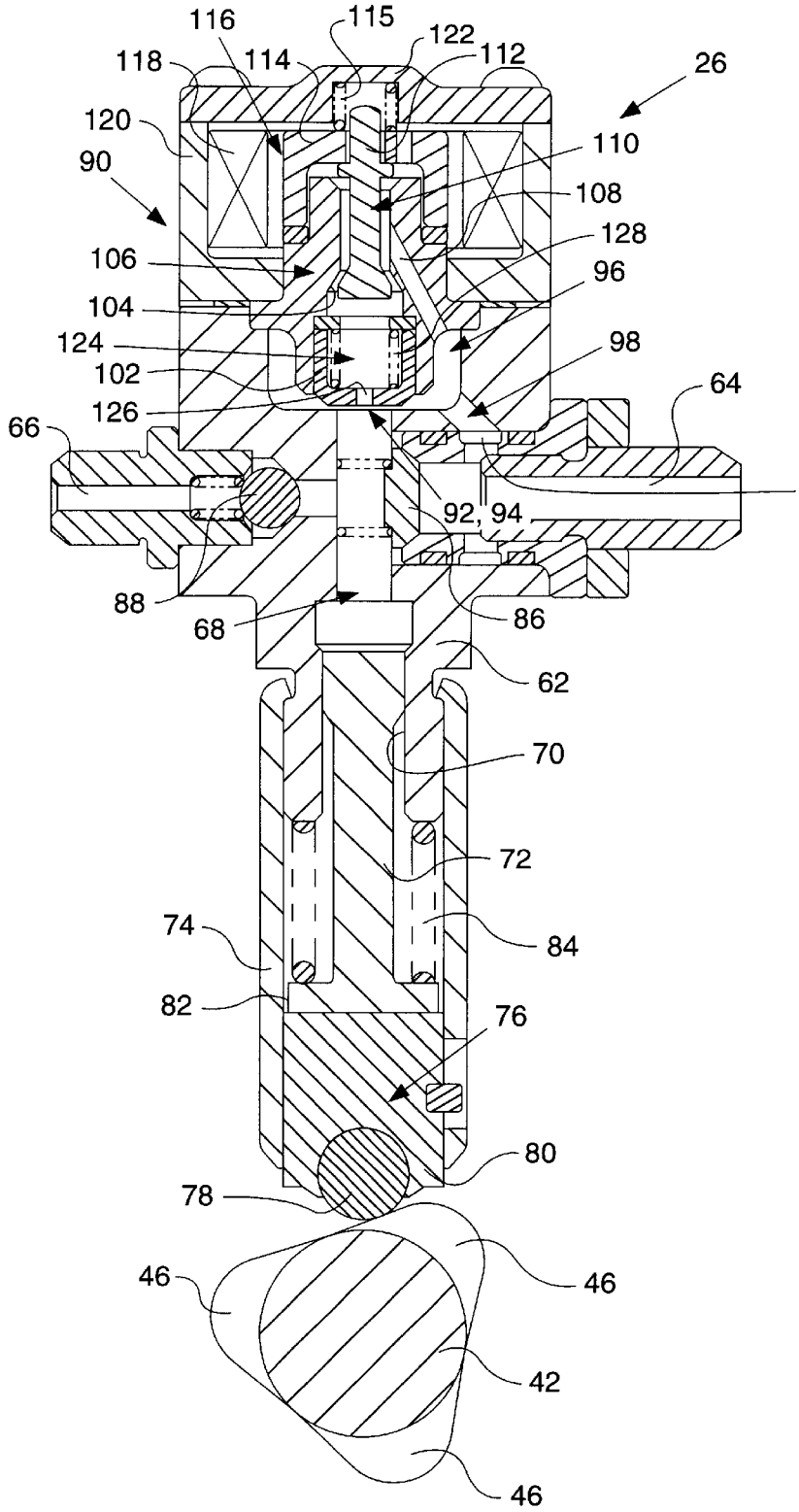
FIG. 3 is a cross-sectional view of the pump shown in FIG. 2.

FIG. 3 illustrates one embodiment of a unit pump 26 in greater detail. The unit pump 26 comprises a barrel 62 having an inlet 64 and an outlet 66 communicating with a pump chamber 68 formed within the barrel 62. The pump chamber 68 includes a cylindrical portion 70 that receives a piston or plunger 72. A follower guide 74 is attached to the barrel 62 concentric with the plunger 72, and a follower assembly, generally designated 76, is slidable within the follower guide 74. Together, barrel 62 and follower guide 74 can be considered the pump housing. The follower assembly 76 comprises a roller follower 78 rotatably mounted to a cylindrical guide block 80. While a roller follower is preferred, other suitable followers may also be used. The plunger 72 is provided with a flange 82 at its lower end, which engages the guide block 80. A spring or other suitable bias member 84 is disposed between the flange 82 and the barrel 62 to bias the plunger 72 and guide block 80 downward. The roller follower 78 travels along the surface of the cam lobes 46 as the camshaft 42 rotates, causing the plunger 72 to be driven upwardly within the barrel 62 as the roller follower 78 travels along the upward slope of each lobe 46. As the roller follower 78 travels along the downward slope of a cam lobe 46, the spring 84 biases the roller follower 78 against the cam lobe 46 and the plunger 72 is drawn downwardly within the barrel 62.

The downward stroke of the plunger 72 is the intake stroke of the unit pump 26, which draws fluid into the pump chamber 68 from the inlet 64 through a spring-biased inlet check valve 86. After completion of the intake stroke, the plunger 72 is driven upwardly through its compression or pumping stroke. During the pumping stroke, the inlet check valve 86 is forced closed so that fluid in the pump chamber 68 is pumped either through a spring-biased outlet check valve 88 or through solenoid-controlled, pilot operated by-pass valve, generally designated 90, which will be described below in greater detail. Oil pumped through the outlet check valve 88 is delivered through the outlet 66 to the high pressure rail 28.

Figure 4:
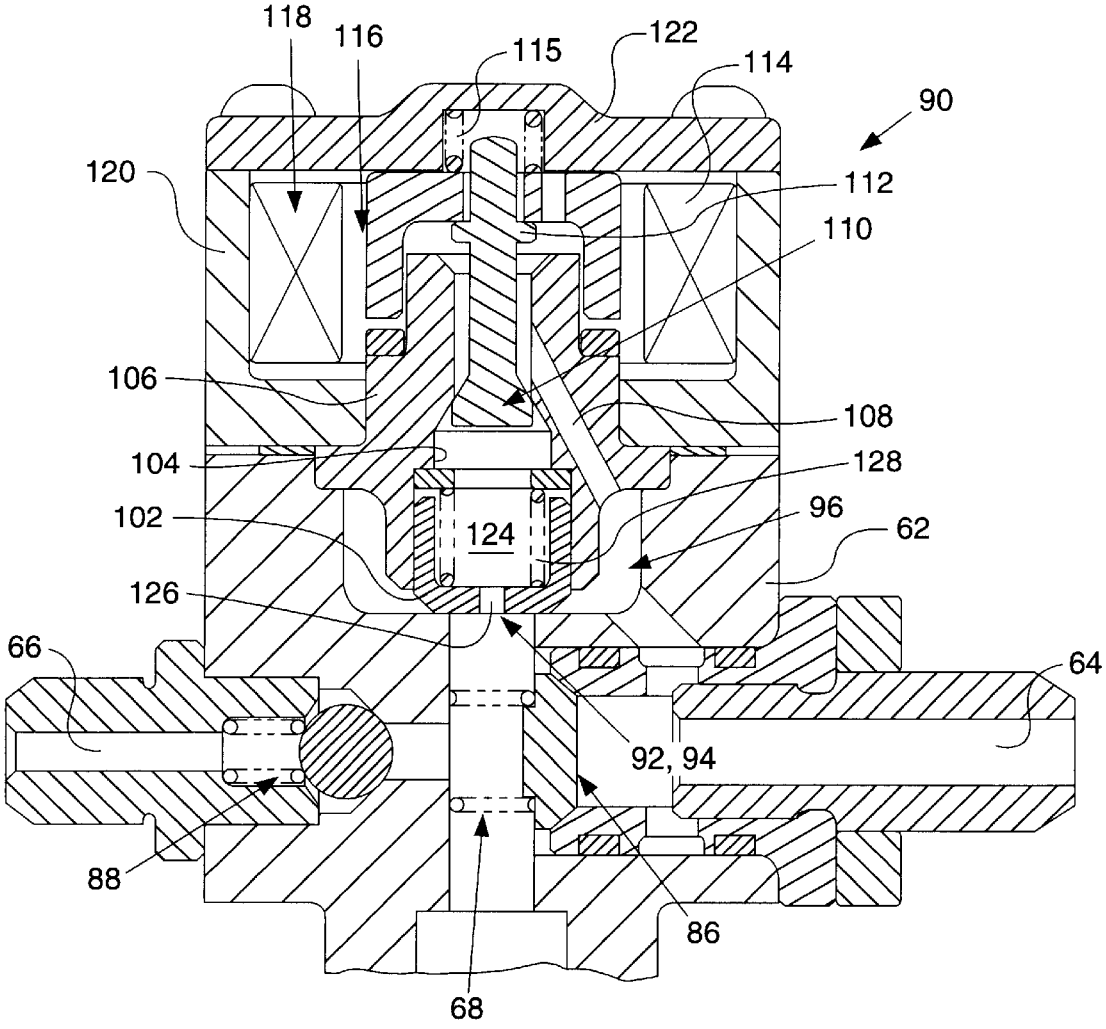
FIG. 4 is an enlarged cross-sectional view of a by-pass valve assembly in accordance with this invention, which is shown in FIG. 3.

With reference to FIGS. 3 and 4, the by-pass valve 90 is formed in part by the barrel 62, which has an outlet 92, which also serves as the primary inlet port 94 of the valve 90. The inlet 94 opens to a cavity 96 defined by the barrel 62, and a passageway 98 extends from the cavity 96 to the inlet 64 of the unit pump 26. The passageway 98 forms a primary outlet port 100 of the by-pass valve 90. A thimble-like primary valve closure member 102 is disposed in confronting relationship with the primary inlet port 94, and upwardly extending walls of the primary closure member 102 are slidably received within a bore 104 in a secondary valve block 106, which is located atop the barrel 62 and seals the upper margin of the cavity 96. The bore 104 of the secondary valve block 106 extends through the block 106 from top to bottom, and a passageway 108 in the block extends from the bore 104 back to the cavity 96.

A secondary closure member 110 is disposed within the bore 104 in the secondary valve block 106 between the primary valve closure member 102 and the open upper end of the bore 104. The secondary valve closure member 110 includes a stem 112 extending from the bore 104 and connected with an armature 114 of a solenoid assembly, generally designated 116. The solenoid assembly 116 also includes a solenoid coil 118 mounted to a housing 120 fastened to the upper end of the barrel 62. A cover or cap 122 is secured to the top of the housing 120 to enclose the solenoid assembly 116. Activation of the solenoid coil 118 moves the secondary closure member 110 to close the bore 104, whereby a portion of the bore 104 in the valve block 106, the primary closure member 102, and the secondary closure member 110(when the solenoid assembly 116 is activated) define a pressure chamber 124, which will be described in greater detail below.

An orifice 126 is provided in the face of the primary valve closure member 102 in the portion thereof that confronts the by-pass valve inlet port 94, and a spring 128 is disposed between the primary closure member 102 and a confronting wall of the bore 104 to bias the primary closure member 102 downwardly. Spring 128 is preferably relatively weak, and likely could be eliminated except when the pump is oriented upside down from the orientation shown, where gravity could not be relied upon to bias it toward its seated position. The orifice 126 provides a conduit from the pump chamber 68 to the pressure chamber 24, and may be replaced by a passageway (not shown) between the pump chamber 68 and the pressure chamber 124 that is separate from the primary closure member 102.

FIG. 3 illustrates the valve 90 in its inactivated state with plunge 72 beginning its pumping stroke, in which the primary closure member 102 is lifted to open cavity 96 to primary inlet port 94. FIG. 4 shows valve 90 in its closed pumping position. During the pumping stroke of the plunger 72, pressure builds within the pump chamber 68, and that pressure forces the primary closure member 102 upward, opening the primary inlet port 94 to the cavity 96 and permitting fluid from the pump chamber 68 to pass through the cavity 96, into the passageway 98, and back to the inlet 64 of the unit pump 26. Fluid also flows through the orifice 126 in the primary closure member 102, around the secondary closure member 110, into the passageway 108 in the secondary valve block 106, and back to the cavity 96, where it can then travel through the passageway 98 and back to the unit pump inlet 64. Orifice 126 preferably has a flow area such that when plunger 72 is undergoing its pumping stroke a pressure gradient between pump chamber 68 and pressure chamber 124 is sufficient to cause primary closure 102 to lift to its open position, as shown in FIG. 3. If orifice 126 is made to large, the pressure gradient phenomenon necessary to lift primary closure member 102 to its upper open position might not occur. In addition, the flow area past secondary closure member 110 should preferably be large enough to accommodate whatever relatively small amount of fluid flow occurs through orifice 126 so that the necessary pressure gradients to cause the valve to perform in its preferred manner can develop. When by-pass valve 90 is open, no fluid is pumped through outlet check valve 88 since the path through the by-pass valve 90 is the path of least resistance.

To start the effective pumping stroke of the unit pump 26, current is applied to the solenoid coil 118, which in turn causes the armature 114 and the secondary closure member 110 to be moved upwardly. As the secondary closure member 110 moves upwardly, it closes the bore 104 so that fluid passing through the orifice 126 can no longer travel to the cavity 96 and back to the unit pump inlet 64. As a result, the pressure chamber 124 is created, and pressure quickly builds within the pressure chamber 124 until the pressure in the pressure chamber 124 is equal to the pressure in the pump chamber 68. Thus, the pressure applied to the portion of the primary closure member 102 confronting the primary inlet port 94 is equal to the pressure applied the opposing walls of the pump chamber 68. However, the opening hydraulic surface area of the primary closure member 102 directly confronting the primary inlet port 94 is smaller than opposing or closing hydraulic surface area within the pressure chamber 124. Consequently, a greater force is applied to the primary closure member 102 from the pressure chamber 124 than from the primary inlet port 94, and the primary closure member 102 is forced downwardly to seal the primary inlet port 94. The armature 114 and secondary valve closure member are biased downwardly by a spring or other bias member 115. Once the pressure within the pressure chamber 124 is sufficient to resist the spring force of spring 115, current to the solenoid coil can be interrupted. Pressure within the pressure chamber 124 will then hold the Secondary closure member 110 in its raised position to close passageway 108 and hold primary closure member 102 in its downward position so that the primary inlet port 94 remains sealed even without current being applied to the solenoid coil 118. Thus, the pressure within the pressure chamber 124 effectively latches the primary closure member 102 and secondary closure member 110 in their respective sealing positions.

With the inlet port 94 to the by-pass valve 90 sealed, fluid in the pump chamber 68 opens the outlet check valve 88 of the unit pump 26 and fluid is delivered from the outlet 66 of the unit pump 26 to the high pressure rail 28. When the plunger 72 reaches the end of its pumping stroke, a new intake stroke begins, which causes the outlet check valve 88 to close and draws fluid both through the inlet 64 and through the orifice 126 in the primary valve closure member 102 of the by-pass valve 90. As pressure is reduced within the pressure chamber 124, the bias spring 115 helps to force the secondary closure member 110 downward to open the pressure chamber 124 to the passageway 104 in the secondary valve block 106.

The illustrated by-pass valve 90 is electrically actuated by use of a solenoid assembly 116. However, it is contemplated that other actuators may be operably coupled to momentarily raise the secondary closure member 112 to create the pressure chamber 124 in the valve 90. For example, a suitable piezo-electric actuator (not shown) may be used in place of the solenoid assembly 116. Other electrically operated actuators may also be used as well as pilot operated hydraulic actuators. In addition, it will be noted that the secondary valve closure member 110 may itself form the armature of the solenoid assembly 116 or may be an integral part of the armature.

Figure 5:
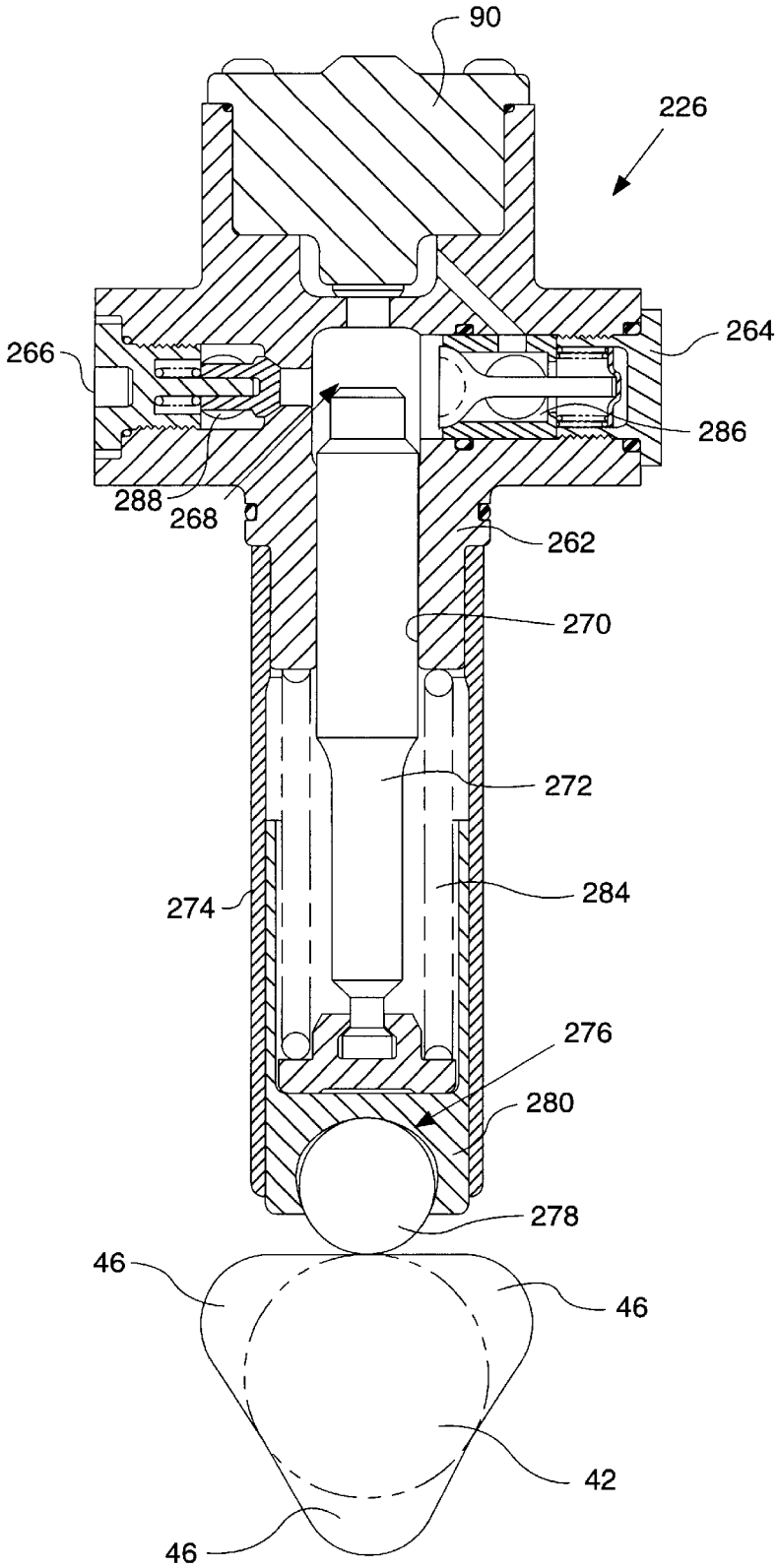
FIG. 5 is a cross-sectional view of a second embodiment of a pump in accordance with this invention.

FIG. 5 illustrates another embodiment of a unit pump, generally designated 226, in accordance with this invention utilizing the electrically actuated, pilot operated by-pass valve 90 described above. The by-pass valve 90 is shown diagrammatically in FIG. 5. The unit pump 226 illustrated in FIG. 5 is constructed similarly to the unit pump 26 illustrated in FIG. 4, and like components, although configured differently, are identified by like reference numbers increased by 200.

Figure 6:
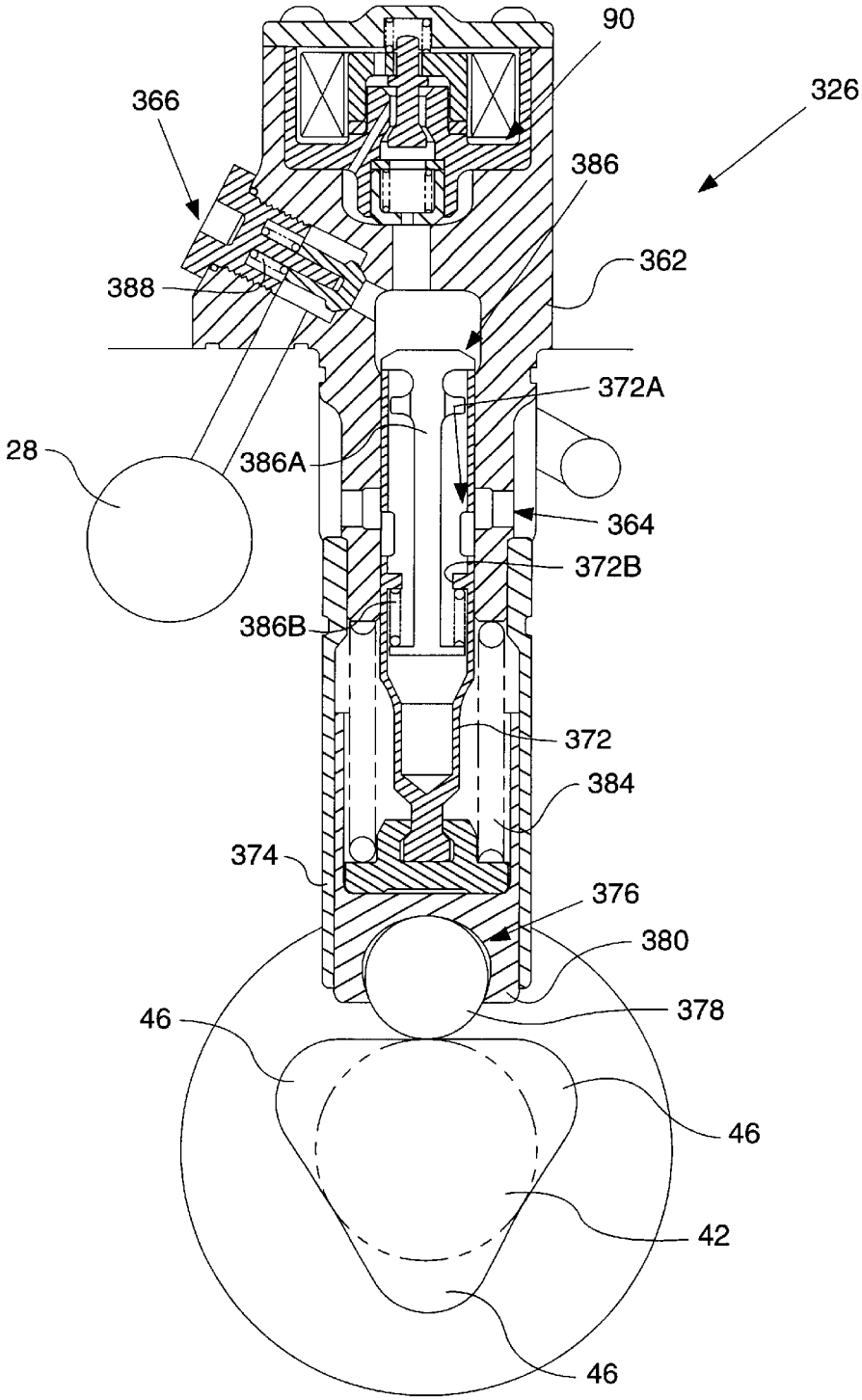
FIG. 6 is a cross-sectional view of a third embodiment of a pump in accordance with this invention.

FIG. 6 illustrates yet another embodiment of a unit pump, generally designated 326, in accordance with this invention utilizing the electrically actuated, pilot operated by-pass valve 90 substantially identical to the by-pass valve 90 described above. Again, like components are given like reference numbers to those shown in FIG. 4 but now increased by 300. The unit pump 326 differs from the unit pumps 26 and 226 in that the unit pump 326 utilizes a hollow plunger 372 having a cavity 372A therein open at its upper end and selectively closed by a plunger-mounted check valve 386, and the inlets 364 to the unit pump 326 open to the hollow interior 372A of the plunger 372. The plunger mounted check valve 386 has a stem 386A which extends within the cavity 372A, and a spring 386B is disposed between a flange 372B extending around the inside diameter of the plunger 372 and an upwardly-facing surface at the lower end of the stem 386A. The bias spring 386B normally positions the plunger mounted check valve 386 such that the sealing portion 387 is pulled downwardly against the open upper end of the plunger 372. During the intake stroke of the plunger 372, fluid is drawn into the plunger 372 and vacuum pressure in the pump chamber 368 opens the plunger mounted check valve 386. As a result, fluid flows from the plunger cavity 372A to the pump chamber 368. During the compression or pumping stroke of the plunger 372, pressure from the fluid in the pump chamber 368 and the spring 386B force the plunger mounted check valve 386 to close so that fluid is then pumped from the pump chamber 368, either through the by-pass valve 90 or through the outlet check valve 388.

Figure 7:
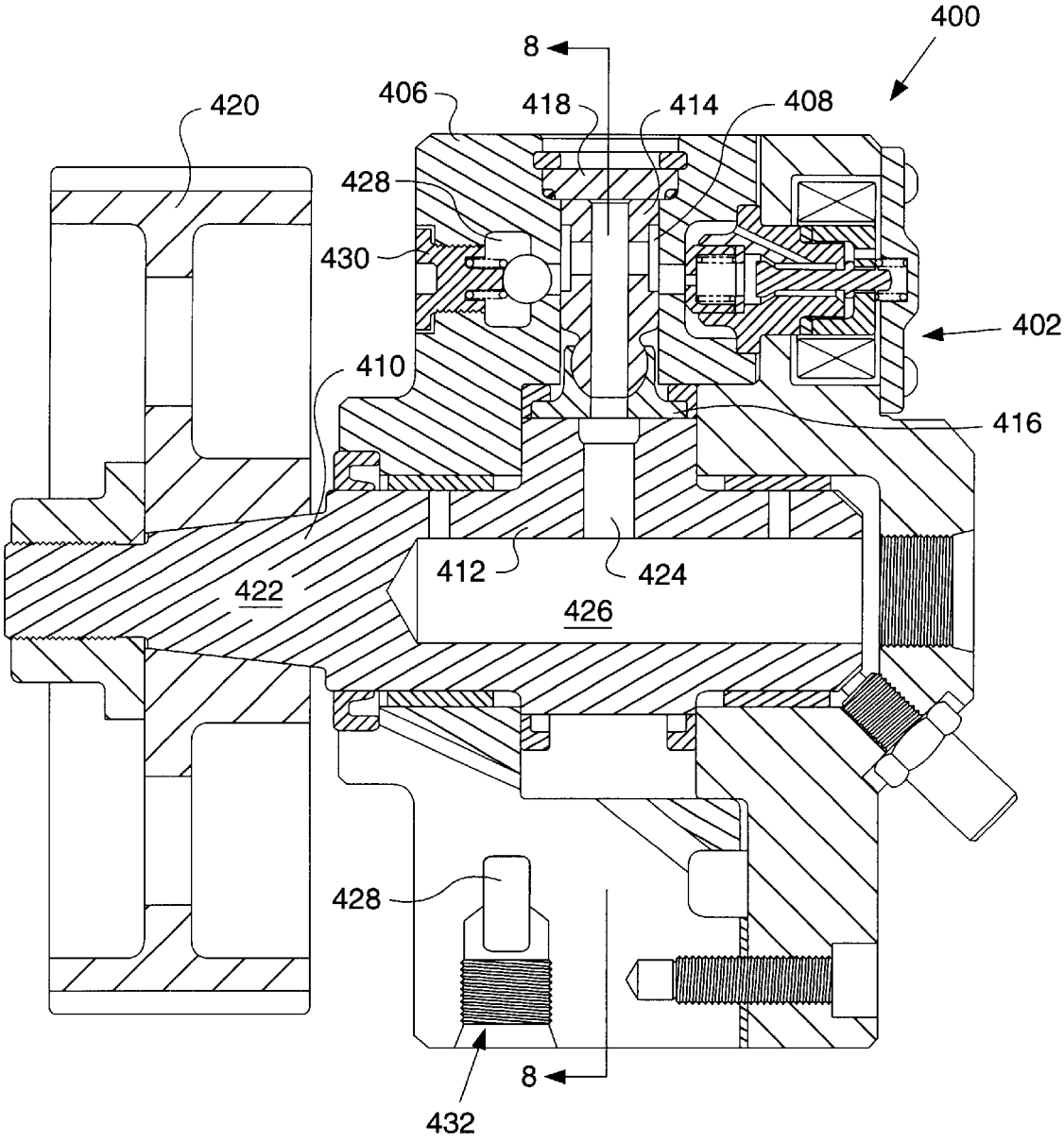
FIG. 7 is a cross-sectional view of a fourth embodiment of a pump in accordance with this invention.
Figure 8:
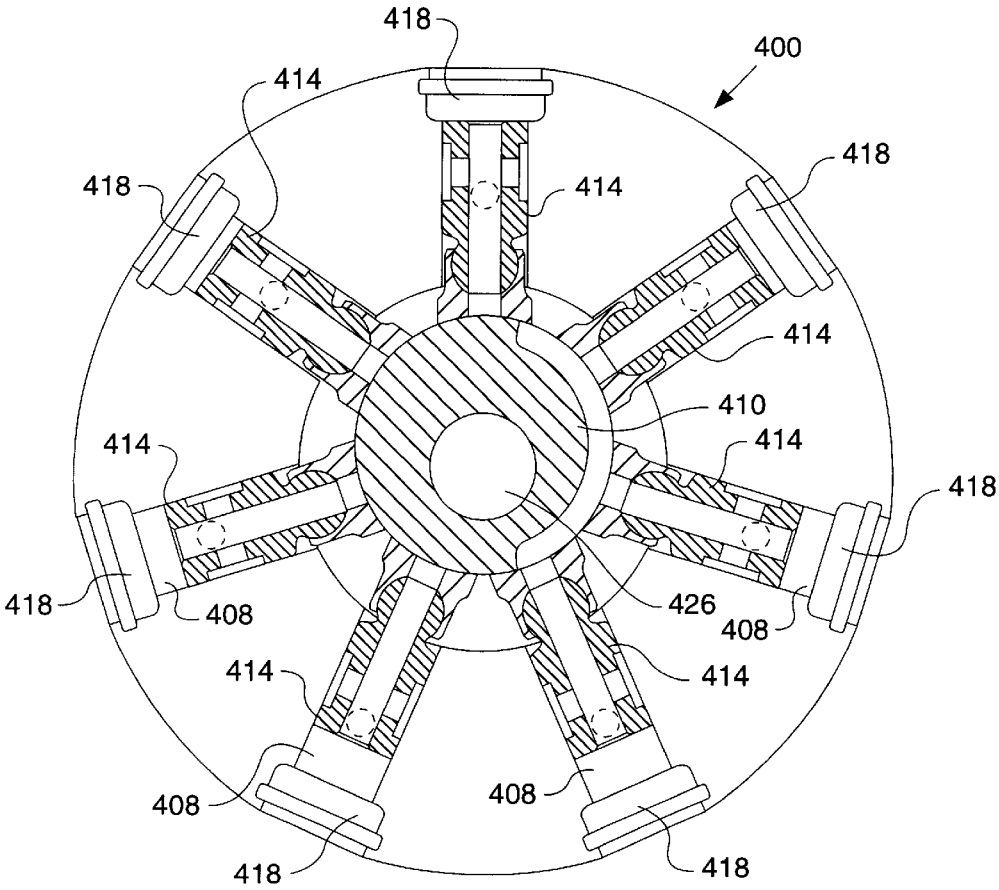
FIG. 8 is a cross-sectional view of the pump shown in FIG. 7 taken along line 8—8 in FIG. 7.

One skilled in the art will recognize that the electrically actuated, pilot operated valve 90 may also be used with pump configurations other than the unit pumps 26, 226, and 326 described above to supply high pressure actuation fluid to the common rail 28. For example, FIGS. 7 and 8 illustrate a multiple piston (plunger) radial pump, generally designated 400, that is provided with multiple electrically actuated, pilot operated by-pass valves 402 as described above with regard to valve 90, namely one by-pass valve 402 associated with each piston 404. The radial piston pump 400 may be of conventional design except for the use of the by-pass valves 402 in accordance with this invention. In general, the radial pump 400 includes a pump housing 406 that defines a plurality of radially-extending cylinders 408. A rotating camshaft 410 extends centrally through the housing 406. The camshaft 410 includes an eccentric cam portion 412 to which a plurality of plungers 414 are attached by conventional shoe assembly 416 disposed in corresponding ones of the cylinders 408. Each of the cylinders 408 is closed at its radially-outer end by a plug 310. As apparent from FIGS. 7 and 8, rotation of the camshaft 410 causes the plungers 414 to reciprocate within their corresponding cylinders 408. The camshaft 410 has an input gear 420 connected for rotation therewith at its free, outer end 422. In the fuel system application described herein, a single radial pump 400 replaces the plural unit pumps 26 and the input gear 420 is driven by a drive gear (not shown) connected with the engine crankshaft 44. Thus rotation of the crankshaft 44 is imparted to the camshaft 410 of the radial pump 40. In other non-fuel systems applications, the camshaft 410 is similarly rotated by a suitable drive motor (not shown) or other input device.

During the downward stroke of each plunger 414, that plunger 414 overlies an inlet slot 424 in the eccentric cam portion 412 that opens to a counterbore 426 in the camshaft 410. The counterbore 54 is in fluid communication with a supply of fluid, such as the engine oil gallery 36 (FIG. 1) described above, so that fluid is drawn through the counterbore 426 and slot 424 and into the plunger 414 and cylinder 408. During the upward or compression stroke of each plunger 414, the plunger 414 is not aligned with the inlet slot so that the cylinder 408 is not open to the counterbore 426. Thus, during the compression stoke, fluid previously drawn into the plunger 414 is pumped either through its associated by-pass valve 402 and back to the fluid supply via a return passageway (not shown) or to a circumferential outlet gallery 428 through an outlet check valve 430. As apparent, high pressure fluid from the delivery gallery 428 is then delivered through an outlet 432 to a hydraulically powered device, such as the common rail 28 of the fuel system 20.

Alternatively, each plunger 414 may have a dedicated delivery gallery, which may be selectively interconnected with other ones of the delivery galleries, so that the radial pump 400 can be operated as one multi-piston, variable delivery pump, or as plural multi-piston, variable delivery pumps, or even as plural single piston, variable delivery pumps. Although only one plunger 414 of the radial pump 400 is illustrated in detail in FIG. 7, it will be understood that each of the plungers 414 and cylinders 408 may be substantially identical to those shown in FIG. 7. However, the pump 400 may alternatively be configured such that only one or some of the plungers 414 has a by-pass valve 402 to provide variable delivery, in which case variable delivery from the pump 402 is still achieved but with a smaller delivery range.

Figure 9:
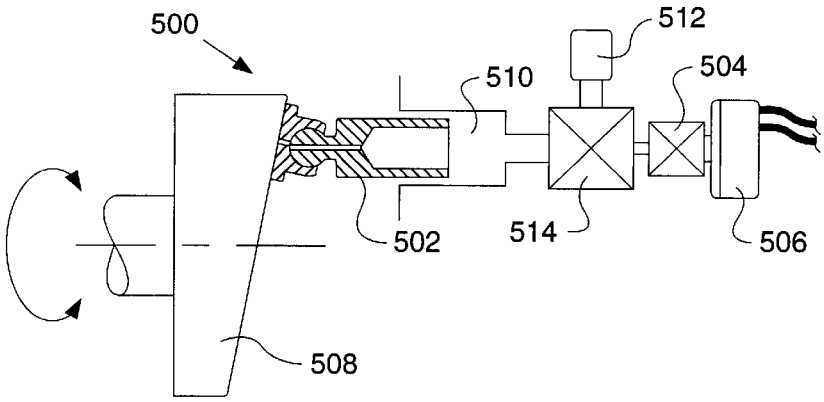
FIG. 9 is a diagrammatic illustration of a fifth embodiment of a pump in accordance with this invention.

FIG. 9 diagrammatically illustrates another embodiment of a pump, generally designated 500, in accordance with this invention. The pump 500 is a multi-piston axial pump (with only one piston illustrated), which may be of any conventional design except that the outlet of each plunger 502 is provided with an electrically-controlled, pilot operated valve 504 as described above with respect to pump 90, including a solenoid or other actuator 506. The axial pump 500 includes an angled, rotating swash plate 508 that reciprocates the plunger(s) 502 within a cylinder 510 in a well known manner. The valve 504 in accordance with this invention controls flow to the outlet collector 512 through main inlet/outlet valve 514 in the manner described above. As with radial pump 400, the fewer than all of the plungers 502 of the axial pump 500 may be provided with by-pass valves 504, and each plunger 502 may pump fluid to a dedicated delivery gallery (not shown) that may be selectively interconnected with the delivery galleries of the other plungers 502.

INDUSTRIAL APPLICABILITY

Operation of this invention will be described in the context of the unit pump powered fuel injection system 20 shown in to FIGS. 1 through 4. The unit pumps 26 are controlled by the ECM 50 to vary effective pumping stokes of at least some of the unit pumps 26. For each unit pump 26, after the ECM 50 senses that the plunger 72 has reached bottom dead center (based on cam lobe position determined by crankshaft position), the solenoid assembly 116 or other actuator of the by-pass valve 90 is supplied with current after a delay period determined by the ECM 50 based on the desired effective pumping stroke of the unit pump 26. After the plunger 72 reaches bottom dead center but before application of current to the solenoid assembly 116, fluid is spilled or by-passed from the pump chamber 68 back to the inlet 64 through the by-pass valve 90. When current is applied to the solenoid assembly 116, the by-pass valve 90 is quickly latched in its closed condition by internal fluid pressure, as described above. Fluid from the pumping chamber 68 is then directed through the outlet check valve 88 and to the common high pressure fluid rail 28.

The use of electrically actuated, pilot operated valve 90, as described above, to control flow from the pumping chamber of a pump is advantageous for several reasons. In particular, the valve 90 may be pressure latched in its closed condition by only momentary activation of the solenoid assembly 116 or other actuator. Consequently, the valve 90 acts in a digital manner, in that it latches in its closed position for the remaining duration of the pumping stroke of the pump regardless of the duration for which current is applied to the actuator. In addition, the valve 90 may be actuated and latched closed extremely quickly ñon the order of a few microseconds. In other words, the valve changes states and latches in the closed state quickly in response to current application of any reasonable duration.

This quick response is due at least in part because the bypass valve 90 of the present invention separates the control aspects from the fluid flow requirements so that the often conflicting requirements of these two functions do not cause compromises of the type briefly discussed in the background art section. In other words, primary closure member 102 and its associated features are designed to accommodate fluid flow and the ability to change positions quickly. This permits the secondary closure member 110 to not have to accommodate any substantial amount of fluid flow so that it can be designed essentially as a pressure switch with an extremely short travel distance. This in turn permits the usage of relatively less powerful solenoid while retaining extremely fast response times. Due to this ability to quickly latch valve 90, the valve 90 may be used advantageously as described above to provide high precision, fast response variable delivery from an otherwise conventional fixed displacement piston pump. Moreover, the valve 90 obviates the need for sophisticated mechanical structures, such as wobble plate assemblies and/or sleeve metering assemblies, that are typically used to provide variable delivery from a piston pump.

The digital latching, precision delivery, and quick responsive allow rapid and precise variation of the pressure of the fluid in the common rail 28. As a result, the rapid variations of the pressure in the fluid supplied to the unit injectors 22 can be achieved to vary the characteristics of each individual injection of fuel into the associated combustion chamber of the engine 22. In addition, because the solenoid assembly 116 or other actuator only requires momentary activation to close and latch the valve 90, sustained and/or high currents are not required. Consequently, a single current driver (not shown) may be used to control several valves 90. This is particularly useful in high speed engines in which injection events occur with high frequency.

Use of the valve 90 in a multiple piston pumps, such as the pumps shown in FIGS. 7 through 9, provide additional advantages other than precision variable delivery. Because the output of each piston/cylinder combination can be independently controlled, the pump 400,500 may be used to drive two or more separate hydraulically powered systems. For example, the output of one or more of the piston/cylinder combinations may be used to drive a hydraulically powered fuel injection system whereas of output from other piston/cylinder combinations may be used to power, among other things, a vehicle anti-lock braking system (ABS), active suspension, engine supercharger, power steering, a hydrostatic drive mechanism, or non-propulsion related systems such as hydraulically powered machine implement systems. A system in which plural devices are driven by a common pump is illustrated in U.S. Pat. No. 5,540,203 to Foulkes et al., which is incorporated herein by reference.

One skilled in the art will also recognize that the valve 90 is useful not only as a by-pass valve to provide variable delivery from fluid pumps, but also in any application where flow control of a fluid is desired.

Although the presently preferred embodiments of this invention have been described, it will be understood that within the purview of the invention various changes may be made within the scope of the following claims.

What is claimed is:

1. A variable delivery pump comprising:

a pump housing defining a pump chamber, a pump inlet and a pump outlet;

at least one plunger positioned to reciprocate in said pump housing; and a by-pass valve including an electrically operated actuator and a valve block attached to said pump housing and defining a valve inlet fluidly connected to said pump chamber, and further including a primary closure member movably positioned in said valve block, and a secondary closure member movably positioned in said valve block and operably coupled to said electrically operated actuator.

2. The variable delivery pump of claim 1 wherein said primary closure member includes an opening hydraulic surface area exposed to fluid pressure in said pump chamber; and said primary closure member includes a closing hydraulic surface exposed to fluid pressure in a pressure chamber defined at least in part by said secondary closure member.

3. The variable delivery pump of claim 2 wherein said opening hydraulic surface area is smaller than said closing hydraulic surface area when said primary closure member is in a closed position.

4. The variable delivery pump of claim 2 including a biasing member operably positioned in said valve block to bias said primary closure member toward a closed position.

5. The variable delivery pump of claim 1 wherein said pump chamber is fluidly connected to said pump inlet via a first passageway when said primary closure member is in an open position; and said pump chamber is fluidly connected to said pump inlet via a second passageway when said secondary closure member is in an open position.

6. The variable delivery pump of claim 5 wherein a portion of said second passageway is a pressure chamber defined at least in part by said secondary closure member and said primary closure member.

7. The variable delivery pump of claim 6 wherein another portion of said second passageway is an orifice defined by said primary closure member.

8. The variable delivery pump of claim 7 wherein said orifice has a flow area that is smaller than a flow area past said primary closure member when said primary closure member is in said open position.

9. The variable delivery pump of claim 1 wherein said primary closure member includes an opening hydraulic surface area exposed to fluid pressure in said pump chamber;

said primary closure member includes a closing hydraulic surface exposed to fluid pressure in a pressure chamber defined at least in part by said secondary closure member;

said pump chamber is fluidly connected to said pump inlet via a first passageway when said primary closure member is in an open position; and said pump chamber is fluidly connected to said pump inlet via a second passageway when said secondary closure member is in an open position.

10. The variable delivery pump of claim 9 wherein a portion of said second passageway is a pressure chamber defined at least in part by said secondary closure member and said primary closure member;

said closing hydraulic surface being exposed to fluid pressure in said pressure chamber; and another portion of said second passageway is an orifice defined by said primary closure member.

11. A fuel injection system comprising:

a common rail;

a plurality of fuel injectors fluidly connected to said common rail;

a source of fluid;

at least one variable delivery pump with a pump outlet fluidly connected to said common rail and a pump inlet fluidly connected to said source of fluid;

said variable delivery pump including at least one plunger positioned to reciprocate in a pump housing, a by-pass valve including an electrically operated actuator and a valve block attached to said pump housing and defining a valve inlet fluidly connected to a pump chamber, and further including a primary closure member movably positioned in said valve block, and a secondary closure member movably positioned in said valve block and operably coupled to said electrically operated actuator.

12. The fuel injection system of claim 11 wherein said at least one variable delivery pump is a plurality of unit pumps that each have a single plunger.

13. The fuel injection system of claim 12 wherein said primary closure member includes an opening hydraulic surface area exposed to fluid pressure in said pump chamber; and said primary closure member includes a closing hydraulic surface exposed to fluid pressure in a pressure chamber defined at least in part by said secondary closure member.

14. The fuel injection system of claim 13 wherein said pump chamber is fluidly connected to said pump inlet via a first passageway when said primary closure member is in an open position; and said pump chamber is fluidly connected to said pump inlet via a second passageway when said secondary closure member is in an open position.

15. A method of controlling output from a variable delivery pump, comprising the steps of:

providing a variable delivery pump including at least one plunger positioned to reciprocate in a pump housing, a by-pass valve including an electrically operated actuator and a valve block attached to said pump housing and defining a valve inlet fluidly connected to a pump chamber, and further including a primary closure member movably positioned in said valve block, and a secondary closure member movably positioned in said valve block and operably coupled to said electrically operated actuator;

determining a desired effective pumping stroke for said variable delivery pump; and closing said by-pass valve at a timing corresponding to said desired effective pumping stroke at least in part by moving said secondary closure member to a closed position and then applying a hydraulic force to move said primary closure member to a closed position.

16. The method of claim 15 wherein said step of moving said secondary closure member includes activating said electrically operated actuator.

17. The method of claim 16 including a step of deactivating said electrically operated actuator after said activating step but during a pumping stroke.

18. The method of claim 15 wherein said step of applying a hydraulic force includes the steps of:

exposing a closing hydraulic surface on said primary closure member to pressure in a pressure chamber; and fluidly connecting said pressure chamber to said pumping chamber.

19. The method of claim 15 including a step of applying a hydraulic force to move said primary closure member to an open position.

20. The method of claim 15 including a step of exposing an opening hydraulic surface on said primary closure member to fluid pressure in said pumping chamber.

* * * * *